US009874388B2

(12) United States Patent
Prosise et al.

(10) Patent No.: US 9,874,388 B2
(45) Date of Patent: Jan. 23, 2018

(54) SYSTEM FOR PROVIDING COOLING AND STIRRING WITHIN A BEVERAGE CONTAINER

(71) Applicant: BE KNOWN MANUFACTURING, LLC, Cedar Park, TX (US)

(72) Inventors: Roy P. Prosise, Cedar Park, TX (US); Dan Caputo, Cedar Park, TX (US)

(73) Assignee: BE KNOWN MANUFACTURING, LLC, Cedar Park, TX (US)

( * ) Notice: Subject to any disclaimer, the term of this patent is extended or adjusted under 35 U.S.C. 154(b) by 530 days.

(21) Appl. No.: 14/289,107

(22) Filed: May 28, 2014

(65) Prior Publication Data

US 2014/0352349 A1 Dec. 4, 2014

Related U.S. Application Data

(60) Provisional application No. 61/828,246, filed on May 29, 2013.

(51) Int. Cl.
*F25D 3/08* (2006.01)

(52) U.S. Cl.
CPC ..... *F25D 3/08* (2013.01); *F25D 2303/0842* (2013.01); *F25D 2303/0845* (2013.01); *F25D 2331/808* (2013.01)

(58) Field of Classification Search
CPC ..... F25D 3/08; F25D 2331/808; F25D 2303/0842; F25D 2331/81; F25D 2303/08221; F25D 3/14; F25D 2303/082; F25D 31/006; A47G 19/2288; A47G 19/127; A47G 19/2205; A47J 36/2416; A47J 41/0044; B01F 13/0818; B01F 13/08
USPC ..... 62/457.1–457.9
See application file for complete search history.

(56) References Cited

U.S. PATENT DOCUMENTS

| | | | | |
|---|---|---|---|---|
| 2,075,137 | A | 3/1937 | Rosen | |
| 3,088,716 | A * | 5/1963 | Stott | B01F 13/08 310/104 |
| 4,485,636 | A | 12/1984 | Hilado | |
| 5,044,173 | A | 9/1991 | Cheng | |
| 5,148,688 | A | 9/1992 | Pimm et al. | |
| 5,189,892 | A | 3/1993 | Roberts | |
| 5,799,501 | A | 9/1998 | Leonard et al. | |
| D405,316 | S | 2/1999 | Spike | |
| 6,332,706 | B1 | 12/2001 | Hall | |
| 6,474,096 | B1 | 11/2002 | De la Guardia | |
| 6,931,885 | B2 | 8/2005 | Citrynell et al. | |
| 2011/0088410 | A1 | 4/2011 | Negley | |
| 2014/0305927 | A1* | 10/2014 | Alexander | A47G 19/027 219/387 |

* cited by examiner

*Primary Examiner* — Frantz Jules
*Assistant Examiner* — Filip Zec

(57) ABSTRACT

An apparatus includes a container having an interior configured to contain a beverage, and a base configured to support the container on a support surface. A first coupler is mounted to the container. A pod having a second coupler is configured to couple with the first coupler while the pod is located in the interior of the container. The pod physically contacts the beverage and can be configured to rotate within the container.

16 Claims, 3 Drawing Sheets

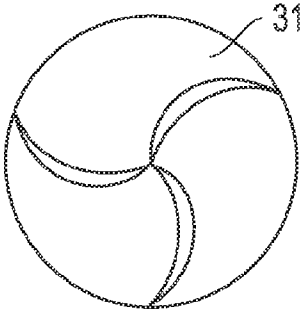
FIG. 3A
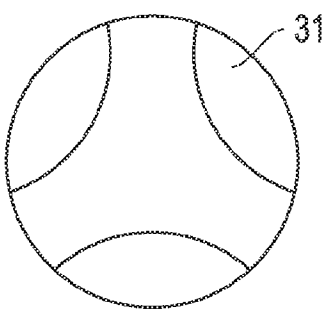
FIG. 3B
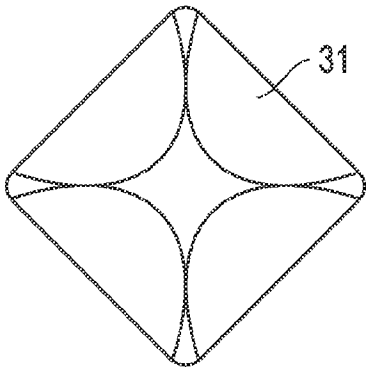
FIG. 3C
FIG. 3D

SYSTEM FOR PROVIDING COOLING AND STIRRING WITHIN A BEVERAGE CONTAINER

This application claims priority to and the benefit of U.S. Prov. App. No. 61/828,246, filed May 29, 2013, and is incorporated herein by reference in its entirety.

BACKGROUND OF THE INVENTION

Field of the Disclosure

The present invention relates in general to manipulating the temperature of a fluid and, in particular, to a system, method and apparatus for affecting the temperature of a beverage.

Description of the Related Art

The temperature at which beverages are served is important to appreciate their qualities and flavors. There are various tables of authorities that show the ideal temperature ranges for each type of beverage, and the temperature ranges vary greatly. Various solutions have been proposed to regulate the desired temperature of a beverage under conditions that reduce the risk of affecting its taste. Improvements in regulating and maintaining the proper serving temperatures of beverages and other contained fluids continue to be of interest.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

FIGS. 3A-3D are top views of alternate embodiments of pods for the apparatus.

The use of the same reference symbols in different drawings indicates similar or identical items.

DETAILED DESCRIPTION

Figure 1C:
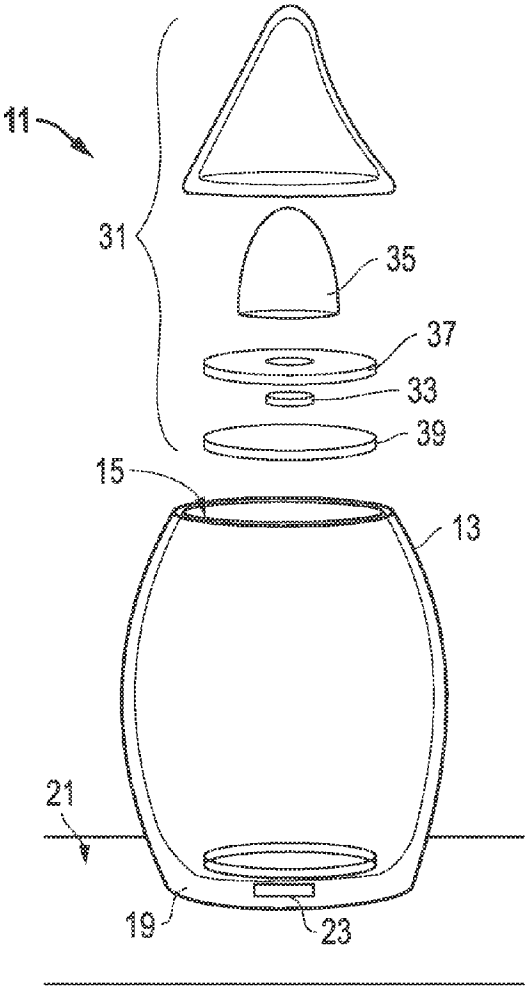
FIGS. 1A-1C are isometric and exploded views of embodiments of an apparatus.
Figure 1B:
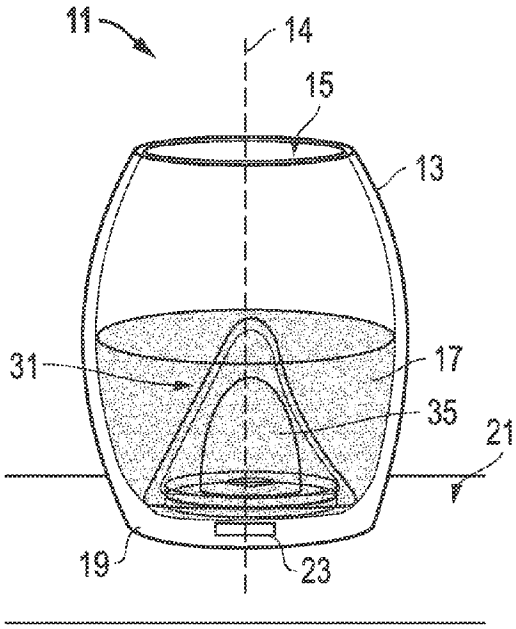
Figure 1A:
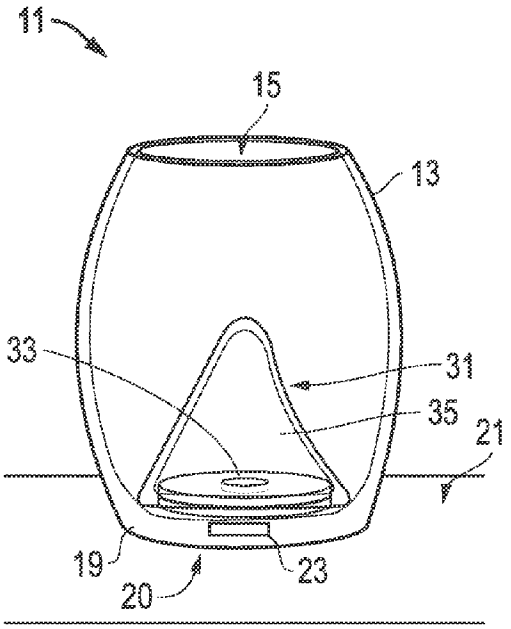

Embodiments of a system, method and apparatus for manipulating the temperature of a fluid are disclosed. For example, an apparatus 11 (FIGS. 1A-1C) may comprise a container 13 having an interior 15 configured to contain a beverage 17 (FIG. 1B). The container 13 may include a base 19 configured to support the container 13 on a support surface 21. The base 19 may be provided with a lower planar exterior surface. Container 13 may be formed from suitable materials, such as glass or plastic.

In some embodiments, a first coupler 23 may be mounted to the container 13. The first coupler 23 may be located inside the base 19. The first coupler 23 may be mounted to the base 19 in the interior 15 of the container 13. In some versions, the first coupler 23 may protrude into at least a portion of the interior 15 of the container 13. A pocket may be formed in the bottom of container 13 for location and retention of first coupler 23. First coupler 23 may be sealed in such a pocket, such as, for example, with silicone sealer epoxy.

The apparatus 11 may further comprise a pod 31 having a second coupler 33 (e.g., a magnet) configured to couple with the first coupler 23 while the pod 31 is located in the interior 15 of the container 13. In this way, the pod 31 physically contacts the beverage 17 (FIG. 1B). The pod 31 may comprise a variety of shapes, such as at least one of conical, taped, fluted, sculpted and helical shapes. The pod 31 may be formed from food grade safe materials as is known in the art.

Embodiments of the pod 31 may be exclusively and completely located within the interior 15 of the container 13, such that versions of the pod 31 do not extend through any portion of the container, such as not through the base 19 of the container 13. As shown in FIGS. 3A-3D, the pod 31 may comprise alternate forms as well, depending on the application. For example, FIG. 3A depicts the top view of a relatively smooth pod 31, such as the pod 31 shown in FIGS. 1A-1C. FIG. 3B comprises an embodiment of pod 31 with concave recesses for enhanced agitation of the fluid in which it can be immersed. Such designs can facilitate expedited aeration of the fluid. In the embodiment of FIG. 3B, three concave fluted sections are shown. In FIG. 3C, an embodiment of a similar but more orthogonal design having four, generally concave flutes are shown. In FIG. 3D, an embodiment of arcuate flutes having three curved radial segments in the version shown.

In some versions (e.g., FIG. 1B), the container 13 may be provided with an axis 14, and the first and second couplers 23, 33 may be configured to axially align along the axis 14. In other versions, the pod 31 may be provided with a recess that is configured to seat on the first coupler 23. The recess may be located on a lower surface of the pod 31, or elsewhere depending on the application.

Embodiments of the pod 31 may contain a material 35. The second coupler 33 and the material 35 may be sealed inside the pod 31, such as by ultrasonic welding. The material 35 may be located within a separate package or separate container that is then located inside the pod 31. The material 35 may have a freezing point of about 0° C. or less. For example, the freezing point of the material 35 may be in a range of about −1° C. to about −30° C. When material 35 is chilled or frozen, material 35 can help maintain or regulate a temperature of a fluid.

Embodiments of the material 35 may comprise a liquid or gel having a high potential heat value and a high specific heat capacity. The material 35 can have good water retention properties and is reusable. The material 35 can be non-toxic, non-polluting and a non-irritant to human contact. The material 35 may comprise water and additives that cause the water to remain a thick gel throughout use, instead of transitioning between a solid and a free-flowing liquid like ordinary water. Such a gel may be formed from non-toxic materials that will not liquefy, and therefore will not spill easily or cause contamination if the container breaks. For example, the gel may be made by adding hydroxyethyl cellulose (e.g., cellusize) or vinyl-coated silica gel to water.

In some versions, the first and second couplers 23, 33 may comprise complementary snap-fit structures. In other versions, the first and second couplers may comprise first and second magnets, respectively. For example, the first and second magnets may comprise rare earth magnets, such as neodymium magnets or samarium-cobalt magnets. The first and second magnets 23, 33 may be individually sealed with seals that are fluid-impermeable. In some embodiments, the first and second magnets 23, 33 may be cylindrical in shape.

Figure 2B:
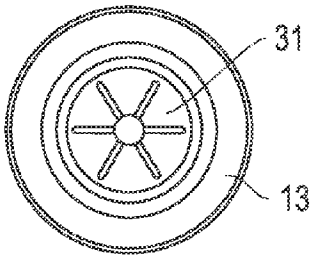
FIGS. 2A-2C are isometric and exploded views of other embodiments of an apparatus.
Figure 2C:
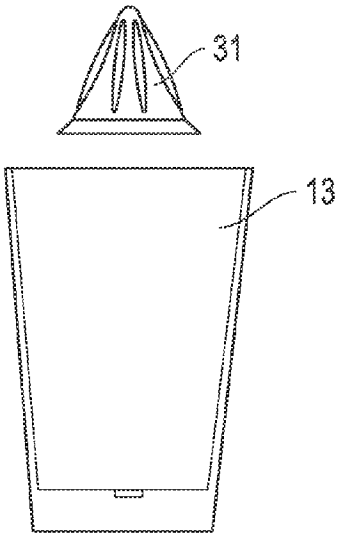
Figure 2A:
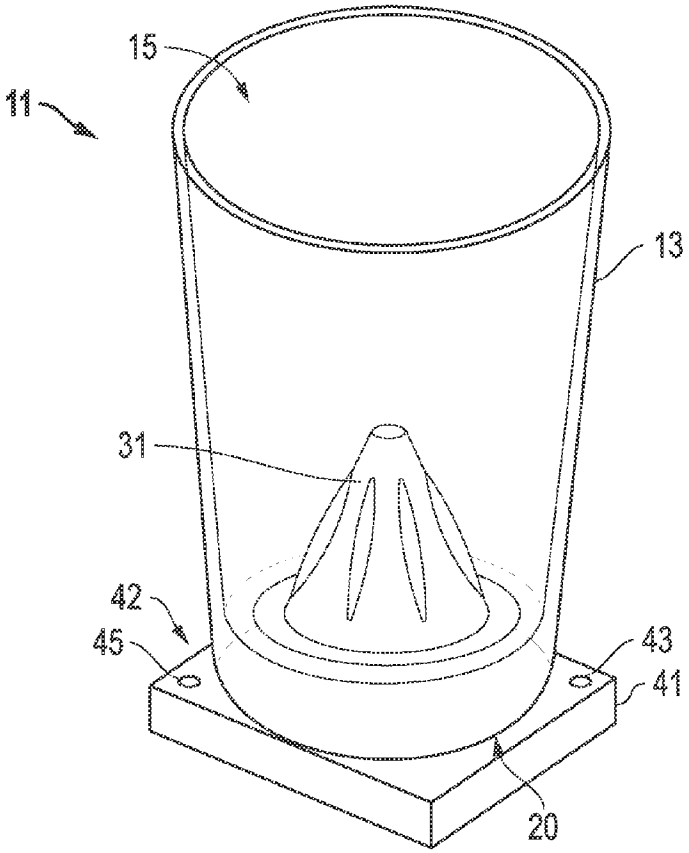

Embodiments of the apparatus 11 may further comprise a platform 41 (FIG. 2A) configured to support the base 19 of the container 13. The platform 41 may be configured to rotate the pod 31 (e.g., about axis 14, FIG. 1B) while the pod 31 is located inside the container 13. For example, the platform 41 may be configured to rotate the pod 31 with a magnetic field. Some versions of the platform 41 may include a switch 43 configured to selectively rotate the pod 31. The system and apparatus may be configured to rotate the pod in a single direction, or to alternately rotate the pod back and forth in opposite rotational directions, such as to produce a 'washing machine' effect in the fluid in which the pad is immersed. A desired amount of separation or clearance between a bottom of the pod 31 and the top of the bottom surface of container 13 may be employed. Such a separation or clearance can help facilitate rotation of pod 31 within container 13 while reducing friction therebetween.

In an embodiment, the apparatus 11 may employ no moving parts. For example, the pod 31 may be rotated by selected electromagnetic force between the magnet in the platform 41 and the magnet in the pod 31.

In other versions, the platform 41 may include a second magnetic field configured to detach the second magnet 33 of the pod 31 from the first magnet 23 of the container 13 for removal of the pod 31 from the interior 15 of the container 13. The platform 41 may include a second switch 45 configured to selectively activate and deactivate the second magnetic field.

In some embodiments, the apparatus 11 may comprise a container 13 having an interior 15 configured to contain a beverage 17. The container 13 may include a lower planar exterior surface 20 configured to support the container 13 on a support surface 21. A first coupler 23 may be mounted to the container 13 adjacent the lower planar exterior surface 20. A pod 31 having a second coupler 33 may be configured to couple with the first coupler 23 in the interior 15 of the container 13 and contact the beverage 17. The pod 31 can have a seal 37 (FIG. 1C) for a sealed interior chamber containing a material 35. The material 35 can have a freezing point of 0° C. or less. The second coupler 33 may comprise another seal 39 for capturing the second coupler 33 on the pod 31, as shown. The pod 31 may be configured to reduce or maintain a temperature of the beverage 17. In addition, a platform 41 may include a support surface 42 (FIG. 2A) configured to support the lower planar exterior surface 20 of the container 13. The platform 41 may be configured to rotate the pod 31 while the pod 31 is located inside the container 13.

In still other embodiments, the apparatus 11 may comprise non-beverage applications, such as medical applications. The apparatus 11 may include a container 13 having an interior 15 configured to contain a fluid 17. A first magnet 23 may be mounted to the container 13. A pod 31 may have a second magnet 33 configured to couple with the first magnet 23 in the interior 15 of the container 13 and contact the fluid 17. The pod 31 can have having a sealed interior chamber containing a material 35 having a freezing point of 0° C. or less. The pod 31 may be configured to help maintain or reduce a temperature of the fluid 35. In addition, a support 41 may be configured to support the container 13. The support 41 can include a magnetic field configured to rotate the pod 31 while the pod 31 is located inside the container 13.

In still other embodiments, a kit may include a plurality of containers 13. Each container 13 may be configured as described elsewhere herein. The kit also may include a plurality of pods 31. Each pod 31 may be configured as described elsewhere herein. The second couplers 33 of the pods 31 may be configured to interchangeably couple with any of the first couplers 23 while the pod 31 is located in the interior 15 of one of the containers 13, such that the pod 31 physically contacts the fluid 17 therein.

Other embodiments may comprise one or more of the following items:

Item 1. An apparatus, comprising:

a container having an interior configured to contain a beverage, and a base configured to support the container on a support surface;

a first coupler mounted to the container; and a pod having a second coupler configured to couple with the first coupler while the pod is located in the interior of the container, such that the pod is configured to physically contact the beverage.

Item 2. The apparatus of item 1, wherein the first coupler is located inside the base.

Item 3. The apparatus of item 1, wherein the first coupler is mounted to the base in the interior of the container.

Item 4. The apparatus of item 1, first coupler protrudes into at least a portion of the interior of the container.

Item 5. The apparatus of item 1, wherein the pod is at least one of conical, taped, fluted, sculpted and helical.

Item 6. The apparatus of item 1, wherein the container has an axis, and the first and second couplers are configured to axially align along the axis.

Item 7. The apparatus of item 1, wherein the pod has a recess that is configured to seat on the first coupler.

Item 8. The apparatus of item 7, wherein the recess is located on a lower surface of the pod.

Item 9. The apparatus of item 1, wherein the pod contains a material having a freezing point of about 0° C. or less, wherein the pod is configured to help maintain or reduce a temperature of the beverage.

Item 10. The apparatus of item 1, wherein the base has a lower planar exterior surface.

Item 11. The apparatus of item 1, wherein the first and second coupler comprise complementary snap-fit structures.

Item 12. The apparatus of item 1, wherein the first and second coupler comprise first and second magnets, respectively.

Item 13. The apparatus of item 12, wherein the first and second magnets are rare earth magnets.

Item 14. The apparatus of item 12, wherein the first and second magnets are individually sealed with seals that are fluid-impermeable.

Item 15. The apparatus of item 12, wherein the first and second magnets are cylindrical in shape.

Item 16. The apparatus of item 1, further comprising a platform configured to support the base of the container, and the platform is configured to rotate the pod while the pod is located inside the container.

Item 17. The apparatus of item 16, wherein the platform is configured to rotate the pod with a magnetic field.

Item 18. The apparatus of item 16, wherein the platform comprises a switch configured to selectively rotate the pod.

Item 19. The apparatus of item 17, wherein the platform comprises a second magnetic field configured to detach a second magnet of the pod from a first magnet of the container for removal of the pod from the interior of the container.

Item 20. The apparatus of item 19, wherein the platform comprises a second switch configured to selectively activate and deactivate the second magnetic field.

Item 21. An apparatus, comprising:

a container having an interior configured to contain a beverage, and a lower planar exterior surface configured to support the container on a support surface;

a first coupler mounted to the container adjacent the lower planar exterior surface;

a pod having a second coupler configured to couple with the first coupler in the interior of the container and contact the beverage, the pod having a sealed interior chamber containing a material having a freezing point of 0° C. or less, wherein the pod is configured to reduce or maintain a temperature of the beverage; and a platform having a support surface configured to support the lower planar exterior surface of the container, the platform being configured to rotate the pod while the pod is located inside the container.

Item 22. An apparatus, comprising:

a container having an interior configured to contain a fluid;

a first magnet mounted to the container;

a pod having a second magnet configured to couple with the first magnet in the interior of the container and contact the fluid, the pod having a sealed interior chamber containing a material having a freezing point of 0° C. or less, wherein the pod is configured to help maintain or reduce a temperature of the fluid; and a support configured to support the container, the support having a magnetic field configured to rotate the pod while the pod is located inside the container.

Item 23. A kit, comprising:

a plurality of containers, each having an interior configured to contain a beverage, and a base configured to support the container on a support surface, and a first coupler mounted to the container; and a plurality of pods, each having a second coupler configured to interchangeably couple with more than one of the first couplers while the pod is located in the interior of one of the containers, such that the pod physically contacts the beverage therein.

Item 24. An apparatus, comprising:

a container having an interior configured to contain a beverage, and a lower planar exterior surface configured to support the container on a support surface;

a first coupler mounted to the container adjacent the lower planar exterior surface;

a pod having a second coupler configured to be located in the interior of the container and couple with the first coupler, the pod being configured to contact the beverage, the pod having a sealed interior chamber containing a material having a freezing point of 0° C. or less, and the pod is configured to reduce or maintain a temperature of the beverage; and a platform having a support surface configured to support the lower planar exterior surface of the container, the platform being configured to rotate the pod while the pod is located inside the container.

Item 25. An apparatus, comprising:

a container having an interior configured to contain a fluid;

a first magnet mounted to the container;

a pod having a second magnet configured to be located in the interior of the container and couple with the first coupler, the pod being configured to contact the fluid, the pod having a sealed interior chamber containing a material having a freezing point of 0° C. or less, and the pod is configured to help maintain or reduce a temperature of the fluid; and a support configured to support the container, the support having a magnetic field configured to rotate the pod while the pod is located inside the container.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An apparatus, comprising:

a container having an interior configured to contain a beverage, and a base configured to support the container on a support surface;

a first coupler mounted to the container;

a pod having a second coupler configured to couple with the first coupler while the pod is located in the interior of the container, such that the pod is configured to physically contact the beverage;

the pod is at least one of conical, fluted and helical; and a platform configured to support the base of the container, the platform is configured to rotate the pod while the pod is located inside the container, and the platform comprises a second magnetic field configured to detach a second magnet of the pod from a first magnet of the container for removal of the pod from the interior of the container.

2. The apparatus of claim 1, wherein the first coupler is located inside the base.

3. The apparatus of claim 1, wherein the first coupler is mounted to the base in the interior of the container.

4. The apparatus of claim 1, wherein the first coupler protrudes into at least a portion of the interior of the container.

5. The apparatus of claim 1, wherein the container has an axis, and the first and second couplers are configured to axially align along the axis.

6. The apparatus of claim 1, wherein the pod has a recess that is configured to seat on the first coupler, and the recess is located on a lower surface of the pod.

7. The apparatus of claim 1, wherein the pod contains a material having a freezing point of about 0° C. or less, wherein the pod is configured to help maintain or reduce a temperature of the beverage.

8. The apparatus of claim 1, wherein the base has a lower planar exterior surface, and the first and second coupler comprise complementary snap-fit structures.

9. The apparatus of claim 1, wherein the first and second coupler comprise first and second magnets, respectively.

10. The apparatus of claim 9, wherein the first and second magnets are rare earth magnets, and the first and second magnets are individually sealed with seals that are fluid-impermeable.

11. The apparatus of claim 9, wherein the first and second magnets are cylindrical in shape.

12. The apparatus of claim 1, wherein the platform is configured to rotate the pod with a magnetic field.

13. The apparatus of claim 1, wherein the platform comprises a switch configured to selectively rotate the pod.

14. The apparatus of claim 1, wherein the platform comprises a second switch configured to selectively activate and deactivate the second magnetic field.

15. An apparatus, comprising:

a container having an interior configured to contain a beverage, and a lower planar exterior surface configured to support the container on a support surface;

a first coupler mounted to the container adjacent the lower planar exterior surface;

a pod having a second coupler configured to be located in the interior of the container and couple with the first coupler, the pod being configured to contact the beverage, the pod having a sealed interior chamber containing a material having a freezing point of 0° C. or less, and the pod is configured to reduce or maintain a temperature of the beverage;

a platform having a support surface configured to support the lower planar exterior surface of the container, the platform being configured to rotate the pod while the pod is located inside the container; and the platform comprises a second magnetic field configured to detach a second magnet of the pod from a first magnet of the container for removal of the pod from the interior of the container.

16. The apparatus of claim 15, wherein the platform comprises a second switch configured to selectively activate and deactivate the second magnetic field.

* * * * *